US011081068B2

(12) United States Patent
Koudo et al.

(10) Patent No.: US 11,081,068 B2
(45) Date of Patent: Aug. 3, 2021

(54) LIQUID CRYSTAL DISPLAY DEVICE AND VIDEO SIGNAL PROCESSING METHOD

(71) Applicants: Panasonic Liquid Crystal Display Co., Ltd., Himeji (JP); Pasona Knowledge Partner Inc., Osaka (JP)

(72) Inventors: Toshikazu Koudo, Hyogo (JP); Hideyuki Nakanishi, Osaka (JP)

(73) Assignees: PANASONIC LIQUID CRYSTAL DISPLAY CO., LTD., Hyogo (JP); PASONA KNOWLEDGE PARTNER INC., Osaka (JP)

( * ) Notice: Subject to any disclaimer, the term of this patent is extended or adjusted under 35 U.S.C. 154(b) by 0 days.

(21) Appl. No.: 16/709,523

(22) Filed: Dec. 10, 2019

(65) Prior Publication Data

US 2020/0193920 A1 Jun. 18, 2020

(30) Foreign Application Priority Data

Dec. 13, 2018 (JP) ..... JP2018-233302

(51) Int. Cl.
*G09G 3/36* (2006.01)

(52) U.S. Cl.
CPC ... *G09G 3/3607* (2013.01); *G09G 2320/0276* (2013.01); *G09G 2320/0285* (2013.01)

(58) Field of Classification Search
CPC ..... G09G 3/3607; G09G 2320/0276; G09G 2320/0285; G09G 3/2092;
(Continued)

(56) References Cited

U.S. PATENT DOCUMENTS 5,315,377 A 5/1994 Isono et al.
2009/0147186 A1 6/2009 Nakai et al.
(Continued)

FOREIGN PATENT DOCUMENTS

JP 5-122733 5/1993
JP 2017-076064 4/2017
(Continued)

OTHER PUBLICATIONS

Office Action issued for the related U.S. Appl. No. 16/709,570, dated Oct. 7, 2020, 12 pages.
(Continued)

*Primary Examiner* — Adam R. Giesy
(74) *Attorney, Agent, or Firm* — Hamre, Schumann, Mueller & Larson, P.C.

(57) ABSTRACT

A liquid crystal display device that displays an input video signal according to a present disclosure comprises: a first liquid crystal display panel and a second liquid crystal display panel disposed to be laminated; a first video signal generator that generates a first video signal for the first liquid crystal display panel by performing stereoscopic vision suppression processing of suppressing stereoscopic vision due to parallax on the video signal; and a second video signal generator that generates a second video signal for the second liquid crystal display panel using the first video signal, wherein when the video signal indicates a black spot, the first video signal generator performs the stereoscopic vision suppression processing with intensity different from that in a case where the video signal indicates a bright spot.

9 Claims, 14 Drawing Sheets

(58) Field of Classification Search
CPC ..... G09G 2300/023; G09G 3/3648; G09G 3/003; G09G 2320/0209; G09G 2320/0257; G09G 2320/0261; G09G 2320/0266; G09G 2320/0271
See application file for complete search history.

(56) References Cited

U.S. PATENT DOCUMENTS

| | | | | |
|---|---|---|---|---|
| 2012/0092468 | A1* | 4/2012 | Okamoto | H04N 13/317 348/55 |
| 2013/0038811 | A1* | 2/2013 | Sugita | G02F 1/1337 349/61 |

FOREIGN PATENT DOCUMENTS

| | | |
|---|---|---|
| JP | 2018-54679 | 4/2018 |
| JP | 2019-090886 | 6/2019 |
| WO | 2007/040127 | 4/2007 |

OTHER PUBLICATIONS

Office Action issued for the related Japanese Patent Application No. 2018-234499, dated Dec. 1, 2020, 9 pages including machine translation.
Office Action issued for the corresponding Japanese patent application No. 2018-233302, dated Jan. 5, 2021, 10 pages including machine translation.

* cited by examiner

LIQUID CRYSTAL DISPLAY DEVICE AND VIDEO SIGNAL PROCESSING METHOD

CROSS-REFERENCE TO RELATED APPLICATION

This application claims priority from Japanese application JP 2018-233302, filed Dec. 13, 2018. This Japanese application is incorporated herein by reference.

BACKGROUND

1. Technical Field

The present disclosure relates to a liquid crystal display device and a video signal processing method performed by the liquid crystal display device, particularly to a liquid crystal display device including two liquid crystal display panels disposed to be laminated.

2. Description of the Related Art

A technique (see International Publication No. WO2007/040127) of improving contrast by laminating (that is, stacking) two liquid crystal display panels has been proposed in the liquid crystal display device. In the technique, expressive power of black is enhanced using the fact that combined transmittance of two liquid crystal display panels is decided by multiplication of transmittances of the two liquid crystal display panels. On the other hand, a parallax problem is generated due to such a two-plate structure of the liquid crystal display panel.

Conventionally, stereoscopic vision suppression processing of reducing a shadow caused by the parallax by performing filter processing on an image displayed on a sub-panel (that is, the liquid crystal display panel for black-and-white display) is performed as a method for improving the parallax problem caused by the two-plate structure of the liquid crystal display panel.

SUMMARY

However, although the conventional stereoscopic vision suppression processing in which the filter processing is used is effective for a place of a black-and-white step in which a straight line is set to a boundary, the stereoscopic vision suppression processing is not properly performed on the place of the black-and-white step, such as a bright spot and a black spot, in which a closed curve like a circle is set to the boundary. For this reason, although the stereoscopic vision of the bright spot is appropriately suppressed, the black spot is stereoscopically seen, or conversely, although the stereoscopic vision of the black spot is appropriately suppressed, the bright spot is stereoscopically seen. As used herein, the bright spot means a high-luminance region surrounded by a low-luminance region. The black spot means the low-luminance region surrounded by the high-luminance region.

The present disclosure has been made in view of the above problems, and an object of the present disclosure is to provide a liquid crystal display device and a video signal processing method for appropriately lessening the parallax problem caused by the two-plate structure of the liquid crystal display panel regardless of whether a display target is the bright spot or the black spot.

To solve the above problem, a liquid crystal display device that displays an input video signal according to a present disclosure comprises: a first liquid crystal display panel and a second liquid crystal display panel disposed to be laminated; a first video signal generator that generates a first video signal for the first liquid crystal display panel by performing stereoscopic vision suppression processing of suppressing stereoscopic vision due to parallax on the video signal; and a second video signal generator that generates a second video signal for the second liquid crystal display panel using the first video signal, wherein when the video signal indicates a black spot, the first video signal generator performs the stereoscopic vision suppression processing with intensity different from that in a case where the video signal indicates a bright spot.

To solve the above problem, a video signal processing method performed by a liquid crystal display device including a first liquid crystal display panel and a second liquid crystal display panel disposed to be laminated according to a present disclosure comprises: a first video signal generating step of generating a first video signal for the first liquid crystal display panel by performing stereoscopic vision suppression processing of suppressing stereoscopic vision due to parallax on an input video signal; and a second video signal generating step of generating a second video signal for the second liquid crystal display panel using the first video signal generated in the first video signal generating step, wherein in the first video signal generating step, when the video signal indicates a black spot, the stereoscopic vision suppression processing is performed with intensity different from that in a case where the video signal indicates a bright spot.

The present disclosure can be to provide a liquid crystal display device and a video signal processing method for appropriately lessening the parallax problem caused by the two-plate structure of the liquid crystal display panel regardless of whether a display target is the bright spot or the black spot.

DETAILED DESCRIPTION

Figure 1:
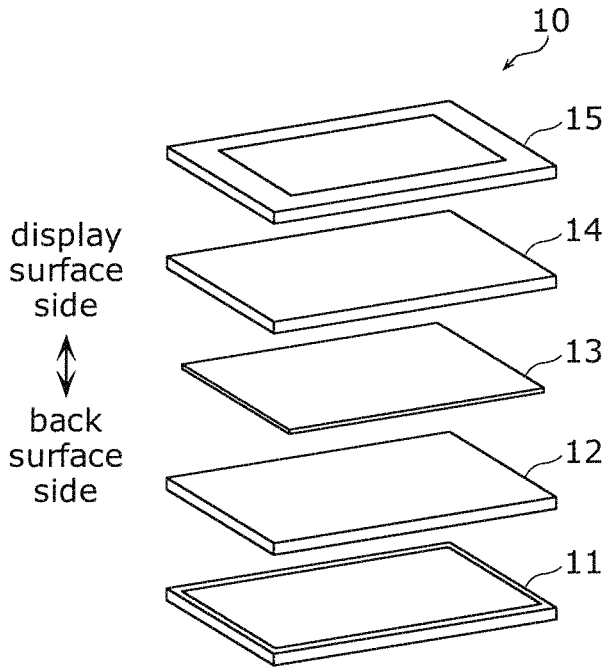
FIG. 1 is a perspective view illustrating a configuration of liquid crystal display device according to the exemplary embodiment.

Hereinafter, an exemplary embodiment of the present disclosure will be described with reference to the drawings. The following exemplary embodiment illustrates a preferable specific example of the present disclosure. Numerical values, shapes, constituent elements, arrangement positions and connection modes of the constituent elements, steps, and order of the steps illustrated in the following exemplary embodiment are examples, and therefore are not intended to limit the present disclosure. Among the constituent elements in the following exemplary embodiment, the constituent elements not recited in the independent claims indicating the broadest concept of the present disclosure are described as optional constituent elements. Each drawing is not necessarily strictly illustrated. In the drawings, substantially the same configuration is designated by the same reference numerals, and sometimes the overlapping description will be omitted or simplified.

FIG. 1 is a perspective view illustrating a configuration of liquid crystal display device 10 of the exemplary embodiment. Liquid crystal display device 10 is constructed with backlight 11, first liquid crystal display panel 12, adhesive layer 13 bonding first liquid crystal display panel 12 and second liquid crystal display panel 14, second liquid crystal display panel 14, and front chassis 15 covering first liquid crystal display panel 12 and second liquid crystal display panel 14 from a display surface side, that are disposed in this order from a back surface side toward a display surface side. In the exemplary embodiment, first liquid crystal display panel 12 located on the back surface side is a black-and-white (that is, gray scale) display panel, and second liquid crystal display panel 14 located on the display surface side is a color display panel. However, the configuration of liquid crystal display device 10 is not limited to this combination, but each of first liquid crystal display panel 12 and second liquid crystal display panel 14 may independently be any one of the black-and-white display panel and the color display panel.

Figure 2:
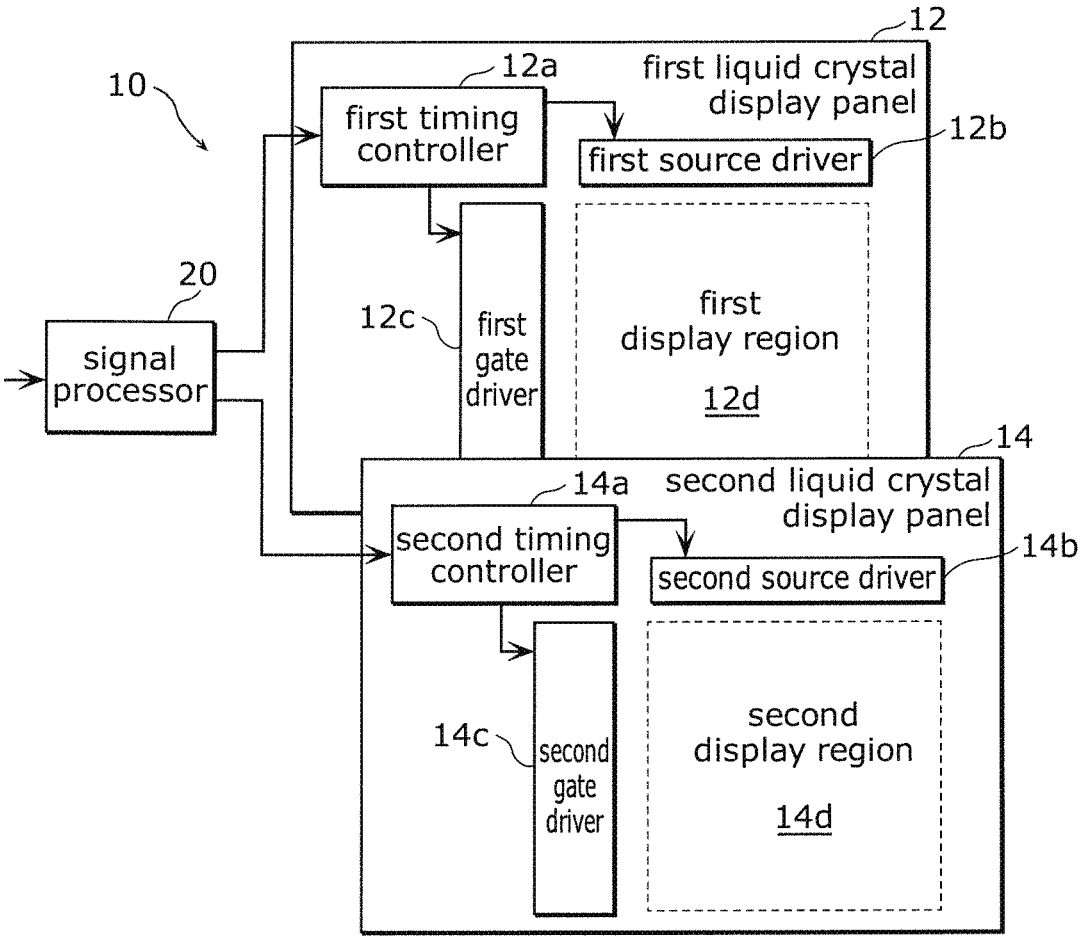
FIG. 2 is a view illustrating a configuration relating to signal processing of liquid crystal display device in FIG. 1.

FIG. 2 is a view illustrating a configuration relating to signal processing of liquid crystal display device 10 in FIG. 1. Liquid crystal display device 10 includes signal processor 20, first liquid crystal display panel 12, and second liquid crystal display panel 14 as a configuration relating to the signal processing.

Signal processor 20 performs processing of appropriately lessening the parallax problem caused by the two-plate structure of the liquid crystal display panel regardless of whether the display target is the bright spot or the black spot, generates a first video signal for first liquid crystal display panel 12 and a second video signal for second liquid crystal display panel 14, and outputs the first video signal and the second video signal to first liquid crystal display panel 12 and second liquid crystal display panel 14 respectively. In the specification, the video includes not only moving images but also still images such as a medical image.

First liquid crystal display panel 12 is a panel (in the exemplary embodiment, the black-and-white display panel) that displays the first video signal output from signal processor 20. First liquid crystal display panel 12 includes first timing controller 12*a* that generates the video signal and a synchronizing signal from the input first video signal, first source driver 12*b* that displays and drives first display region 12*d* according to the video signal generated by first timing controller 12*a*, first gate driver 12*c* that performs display control of first display region 12*d* in units of rows according to the synchronizing signal generated by first timing controller 12*a*, and first display region 12*d* constructed with pixels arranged two-dimensionally.

Second liquid crystal display panel 14 is a panel (in the exemplary embodiment, the color display panel) that displays the second video signal output from signal processor 20. Second liquid crystal display panel 14 includes second timing controller 14*a* that generates the video signal and the synchronizing signal from the input second video signal, second source driver 14*b* that displays and drives second display region 14*d* according to the video signal generated by second timing controller 14*a*, second gate driver 14*c* that performs display control of the second display region 14*d* in units of rows according to the synchronizing signal generated by second timing controller 14*a*, and second display region 14*d* constructed with pixels arranged two-dimensionally.

Figure 3:
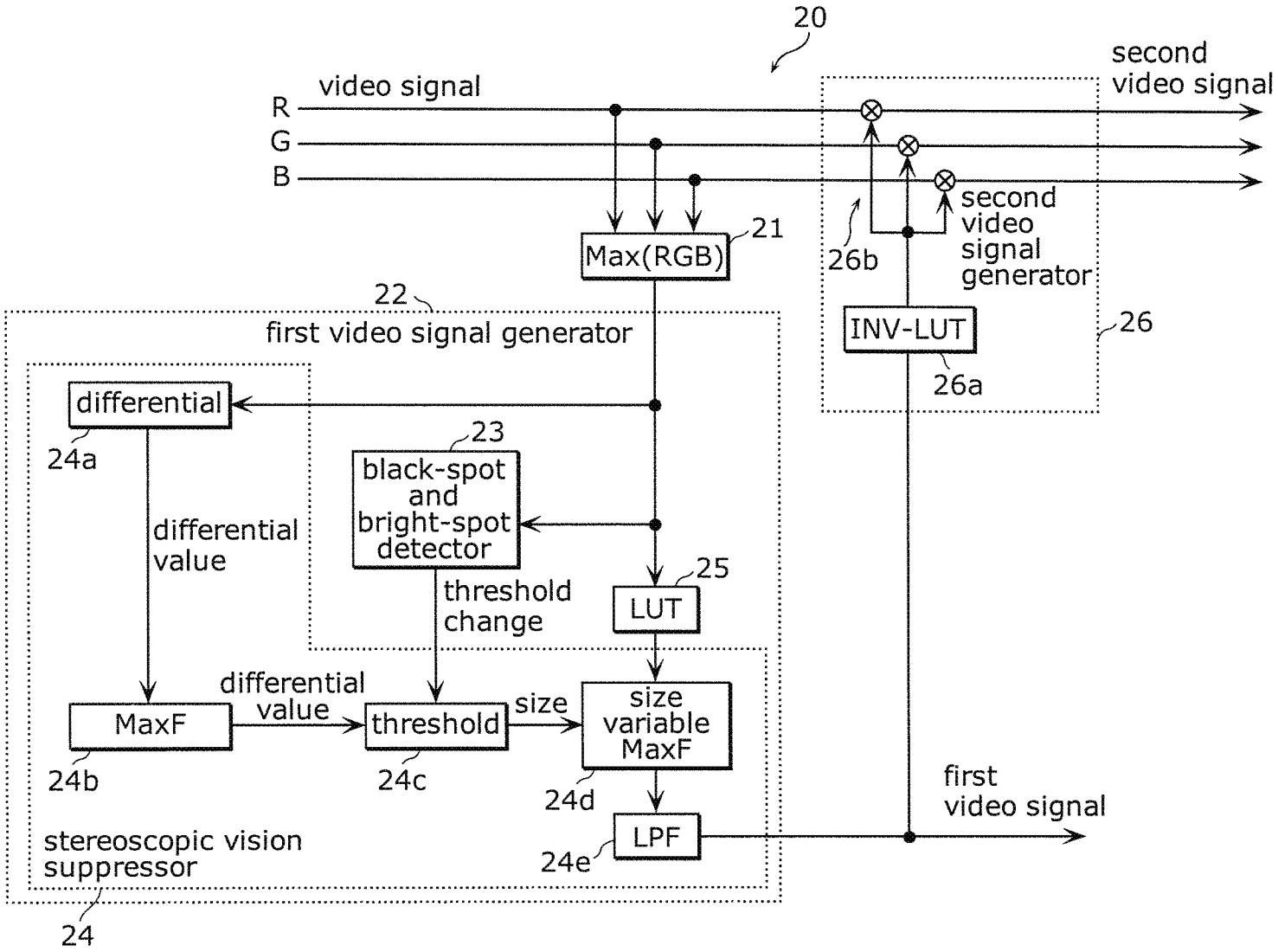
FIG. 3 is a block diagram illustrating a configuration of signal processor in FIG. 2.

FIG. 3 is a block diagram illustrating a configuration of signal processor 20 in FIG. 2. The signal processor 20 includes maximum value processor (Max (RGB)) 21, first video signal generator 22, and second video signal generator 26. In the exemplary embodiment, the input video signal is a signal including a gradation value (R value, G value, B value) of each of three color components (R (red), G (green), B (blue)) for each pixel constituting the image to be displayed.

Maximum value processor 21 is a circuit that extracts a maximum value from the gradation value of each of the three color components included in the input video signal. Specifically, maximum value processor 21 selects and outputs the maximum value of the gradation value (R value, G value, B value) for each pixel with respect to the video signal. Maximum value processor 21 is an example of a processor that converts the input color video signal into the black-and-white video signal, and may be replaced with another system processor (for example, a processor that converts the color video signal into a luminance value using the R value, the G value, and the B value) that converts the input color video signal into the black-and-white video signal. Alternatively, when the input video signal includes a luminance component, maximum value processor 21 may be replaced with a processor that extracts and outputs only the luminance component from the input video signal.

First video signal generator 22 is a circuit that generates the first video signal for first liquid crystal display panel 12 disposed on the back surface side by performing the stereoscopic vision suppression processing of suppressing the stereoscopic vision due to the parallax on the video signal output from maximum value processor 21. First video signal generator 22 includes black-spot and bright-spot detector 23, stereoscopic vision suppressor 24, and gamma corrector (LUT) 25.

Black-spot and bright-spot detector 23 detects whether the video signal output from maximum value processor 21 indicates the black spot or the bright spot, and controls stereoscopic vision suppressor 24 so as to perform the stereoscopic vision suppression processing with intensity different from the case that the bright spot is detected when the black spot is detected. Specifically, black-spot and bright-spot detector 23 instructs threshold processor (threshold) 24*c* of stereoscopic vision suppressor 24 to change a threshold (an instruction to detect the black spot or to detect the bright spot). For example, black-spot and bright-spot detector 23 calculates a difference (differential value) of the gradation value in a vertical direction, a horizontal direction, a diagonal direction, and the like of the region formed by a collection of at least one pixel, determines that the region is the bright spot when a step in which the luminance increases in all directions going outside the region is detected, and determines that the region is the black spot when a step in which the luminance decreases in all directions going outside the region is detected.

Figure 4:
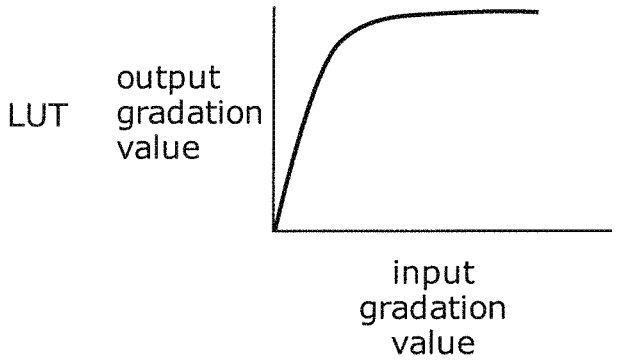
FIG. 4 is a view illustrating an example of gamma characteristic indicated by a look-up table of a gamma corrector in FIG. 3

Gamma corrector 25 is a circuit that performs gamma correction on the video signal output from maximum value processor 21. For example, gamma corrector 25 converts the gradation value using a look-up table indicating a gamma characteristic (a relationship between the input gradation value and the output gradation value) emphasizing contrast of the video displayed on liquid crystal display device 10 as illustrated in FIG. 4. The gamma characteristic in FIG. 4 becomes a curve that is suitable for 2D display in which the contrast is improved for liquid crystal display device 10 by providing a positive correlation between the input gradation value and the output gradation value only to the low input gradation value (that is, dark color).

Stereoscopic vision suppressor 24 is a circuit that generates the first video signal for first liquid crystal display panel 12 disposed on the back surface side by performing the stereoscopic vision suppression processing on the video signal output from gamma corrector 25. Stereoscopic vision suppressor 24 includes differential processor (differential) 24*a*, maximum value filter (MaxF) 24*b*, threshold processor (threshold) 24*c*, size variable maximum value filter (size variable MaxF) 24*d*, and second low-pass filter (LPF) 24*e*.

Differential processor 24*a* is a circuit that calculates a spatial differential value for the video signal output from maximum value processor 21, for example, a circuit that replaces the gradation value of the pixel with a value (that is, a differential value) obtained by performing filter processing (that is, weighted addition) for differential value calculation on the gradation values of the pixel and peripheral pixels (for example, a total of nine pixels including the pixel and eight peripheral pixels).

Maximum value filter 24*b* is a circuit that replaces the differential value output from differential processor 24*a* with the maximum value among the differential values of the pixel and the peripheral pixels (for example, the total of nine pixels including the pixel and the eight peripheral pixels) for each pixels.

Threshold processor 24*c* is a circuit that instructs size variable maximum value filter 24*d* of the size of the maximum value filter used in size variable maximum value filter 24*d* according to the differential value output from maximum value filter 24*b*. At this point, threshold processor 24*c* instructs the size of the maximum value filter used in size variable maximum value filter 24*d* using the threshold decided according to the instruction from black-spot and bright-spot detector 23. As used herein, the size of the maximum value filter means a number of pixels used to calculate the maximum value using the maximum value filter. Threshold processor 24*c* basically instructs size variable maximum value filter 24*d* to have a larger size with increasing differential value input from maximum value filter 24*b*. At this point, threshold processor 24*c* instructs size variable maximum value filter 24*d* to have a size corresponding to the differential value input from maximum value filter 24*b* by changing the threshold used to decide the size, according to the instruction from black-spot and bright-spot detector 23.

Specifically, when receiving an instruction to detect the black spot from black-spot and bright-spot detector 23, threshold processor 24*c* instructs the size of the maximum value filter to be used for size variable maximum value filter 24*d* such that the maximum value filter having the larger size is used in size variable maximum value filter 24*d* than in case of detecting the bright spot.

Size variable maximum value filter 24*d* is a circuit that replaces the gradation value of the pixel indicated by the video signal output from gamma corrector 25 with the maximum value among the gradation values of the pixel and the plurality of pixels adjacent to the pixel using the maximum value filter having the size instructed from threshold processor 24*c*. In this case, basically, the processing is one of expanding a white region by spreading the higher gradation value (whiter color) to the peripheral pixels at a place where a black-and-white step is higher (that is, the differential value is larger) in the input video signal.

Second low pass filter (LPF) 24*e* is a circuit that generates the first video signal for first liquid crystal display panel 12 disposed on the back surface side by spatially smoothing the gradation value indicated by the video signal output from size variable maximum value filter 24*d*. For example, second low pass filter (LPF) 24*e* replaces the gradation value of the pixel with an average value of the gradation values of the pixel and peripheral pixels (for example, a total of nine pixels including the pixel and eight peripheral pixels).

Second video signal generator 26 is a circuit that generates the second video signal for second liquid crystal display panel 14 disposed on the display surface side using the first video signal output from first video signal generator 22. Second video signal generator 26 includes inverse gamma corrector (INV-LUT) 26*a* and multiplier 26*b*.

Inverse gamma corrector 26*a* is a circuit that outputs a value (that is, a coefficient) corresponding to inverse conversion of gamma correction performed by gamma corrector 25 with respect to the input first video signal. For example, inverse gamma corrector 26*a* outputs the coefficient using a look-up table corresponding to the inverse conversion of the gamma correction performed by gamma corrector 25. Multiplier 26*b* multiplies the video signal (that is, each of the R value, the G value, and the B value) input to signal processor 20 by the coefficient output from inverse gamma corrector 26*a*.

Using inverse gamma corrector 26*a* and multiplier 26*b*, second video signal generator 26 generates the gradation value obtained by dividing the input video signal by the gradation value of the second video signal as the second video signal by multiplying the input video signal by the value obtained by performing the inverse gamma correction on the first video signal.

Consequently, the input video signal is separated into the first video signal and the second video signal such that a result of multiplication of the gradation value of the first video signal and the gradation value of the second video signal is matched with the gradation value of the input original video signal.

A characteristic operation of liquid crystal display device 10 of the exemplary embodiment having the above configuration, a problem that can be generated with respect to the bright spot and the black spot caused by the two-plate structure of the liquid crystal display panel, and a solution (video signal processing method) of the problem by liquid crystal display device 10 will be described below.

Figure 5:
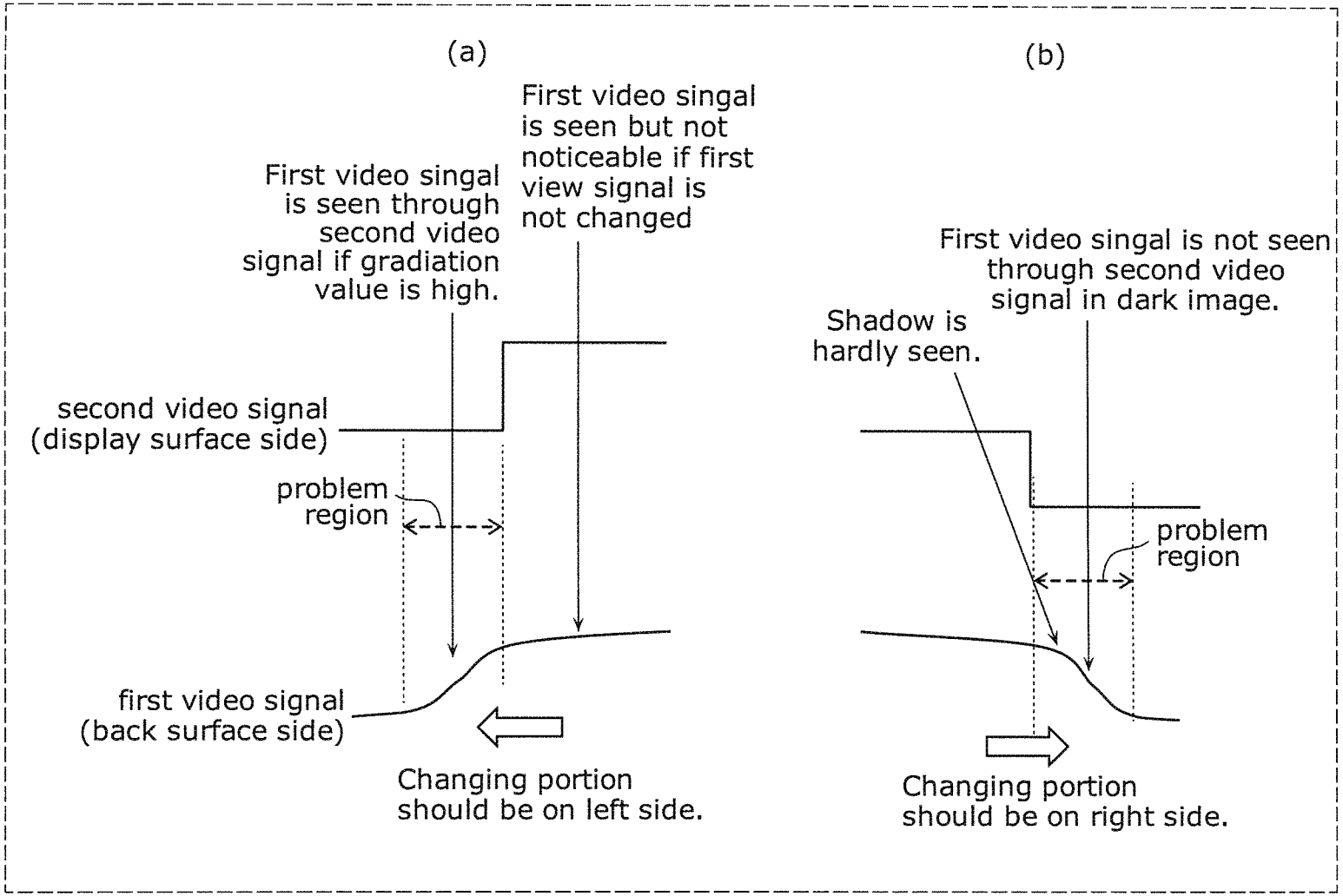
FIG. 5 is a view illustrating the characteristic operation of liquid crystal display device of the exemplary embodiment

FIG. 5 is a view illustrating the characteristic operation of liquid crystal display device 10 of the exemplary embodiment (in this case, the operation of variable-size-maximum-value filter 24*d*). A part (a) of FIG. 5 illustrates an example of a luminance step in a relatively bright image. A part (b) of FIG. 5 illustrates an example of a luminance step in a relatively dark image. In the parts (a) and (b) of FIG. 5, the upper drawing illustrates a luminance distribution of second liquid crystal display panel 14 disposed on the display surface side, and the lower drawing illustrates a luminance distribution of first liquid crystal display panel 12 disposed on the back surface side. The luminance distribution means a distribution in the case where a horizontal axis indicates a position of the pixel in one direction (for example, the horizontal direction) in the liquid crystal display panel while a vertical axis indicates the luminance (whiter as the luminance is higher).

As illustrated in a part (a) of FIG. 5, the first video signal is seen through in the bright region of the second video signal in the luminance step of the relatively bright image, so that an inclined portion (that is, a gradation place or a changing portion (this place is also referred to as a "problem region") of the first video signal is preferably shifted to the left side, namely, the dark region. Similarly, as illustrated in a part (b) of FIG. 5, even in the luminance step of the relatively dark image, the inclined portion (that is, the gradation place or a changing portion) of the first video signal is preferably shifted to the right side, namely, the dark region such that the shadow is hardly seen when viewed obliquely from the bright region of the second video signal (in the direction in which the dark region is seen).

Because the maximum value filter of size variable maximum value filter 24*d* replaces the gradation value of the pixel with the maximum value among the gradation values of the pixel and the plurality of pixels adjacent to the pixel, the maximum value filter shifts the inclined portion (that is, the gradation place) of the first video signal to the dark region. At this point, size variable maximum value filter 24*d* largely shifts the inclined portion (that is, the gradation place) of the first video signal to the dark region (that is, a parallax countermeasure amount is increased (the intensity of the stereoscopic vision suppression processing is increased)) at a place where the black-and-white step is increased (that is, the differential value is increased) by the pieces of processing of differential processor 24*a*, maximum value filter 24*b*, and threshold processor 24*c*.

Thus, the parallax countermeasure amount is decided according to the luminance step (differential value) by the stereoscopic vision suppressor 24 including size variable maximum value filter 24*d*, differentiation processor 24*a*, maximum value filter 24*b*, and threshold processor 24*c*, and the problem that the first video signal is seen through (flare) and the problem that the shadow is seen from the oblique direction (that is, the parallax problem that is three-dimensionally seen) are effectively suppressed.

A problem that can be generated with respect to the bright spot and the black spot due to the two-plate structure of the liquid crystal display panel will be described below.

Figure 6:
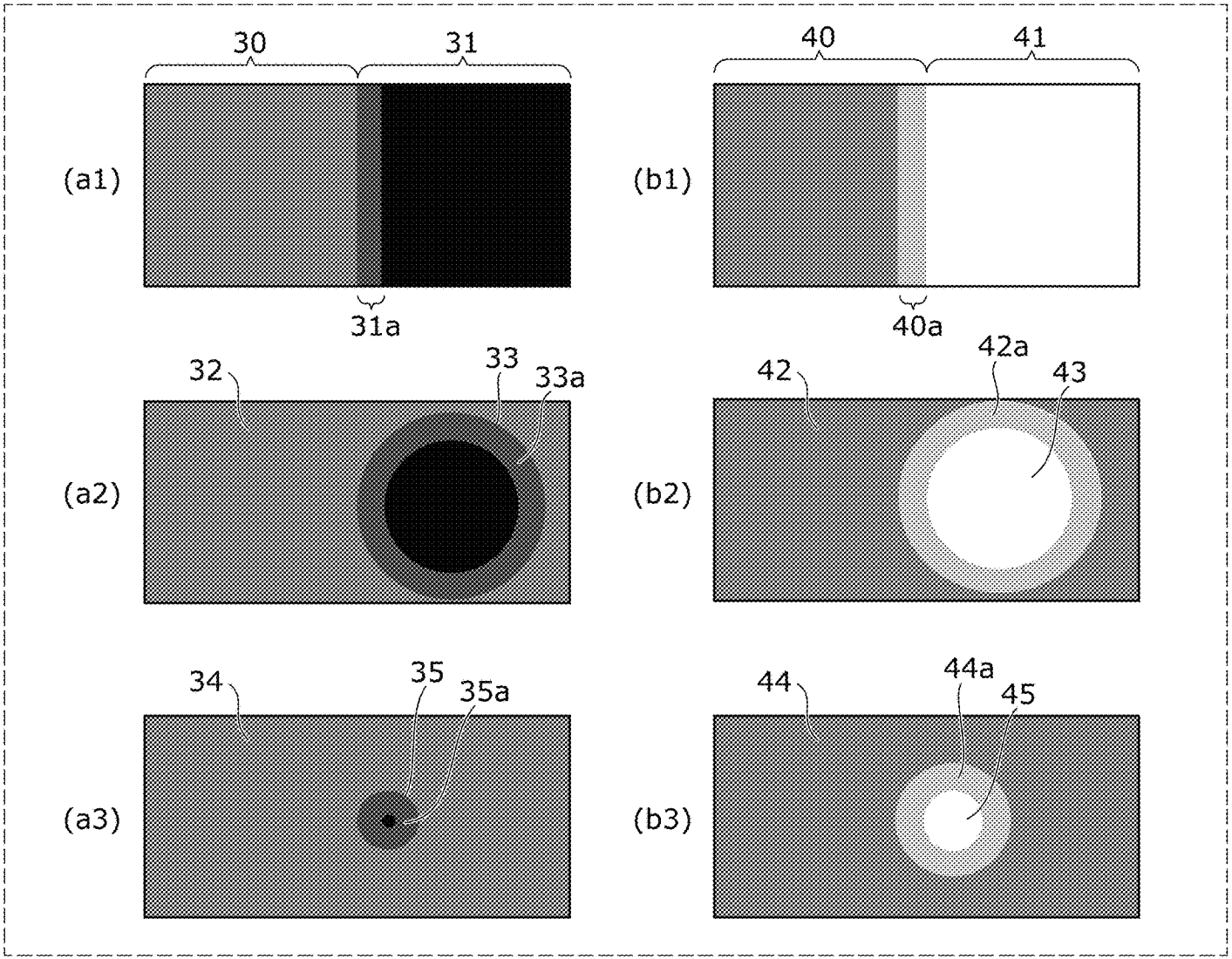
FIG. 6 is a view illustrating the problems that can be generated with respect to the bright spot and the black spot due to the two-plate structure of the conventional liquid crystal display panel.

FIG. 6 is a view illustrating the problems that can be generated with respect to the bright spot and the black spot due to the two-plate structure of the conventional liquid crystal display panel. Display examples of the black regions and the white regions of various shapes by the conventional liquid crystal display panel having the two-plate structure are illustrated in FIG. 6.

A part (a1) of FIG. 6 illustrates a display example when black is displayed in right-half region 31 on a gray background (left-half region 30) using the conventional liquid crystal display panel having the two-plate structure. In this case, the inclined portion (that is, the gradation place) of the first video signal is shifted to lower-luminance right-half region 31 due to the parallax countermeasure using the maximum value filter, so that a place close to left-half region 30 (longitudinal region 31*a*) in right-half region 31 becomes an intermediate color between gray and black.

A part (a2) of FIG. 6 illustrates a display example when black is displayed in relatively large circular region 33 on a gray background (background region 32) using the conventional liquid crystal display panel having the two-plate structure. In this case, the inclined portion (that is, the gradation place) of the first video signal is shifted to the inside of lower-luminance circular region 33 due to the parallax countermeasure using the maximum value filter, so that an inside place (donut-shaped region 33*a*) close to background region 32 in circular region 33 becomes the intermediate color between gray and black.

A part (a3) of FIG. 6 illustrates a display example when black is displayed in relatively small circular region 35 on a gray background (background region 34) using the conventional liquid crystal display panel having the two-plate structure. In this case, the inclined portion (that is, the gradation place) of the first video signal is shifted to the inside of lower-luminance circular region 35 due to the parallax countermeasure using the maximum value filter, so that an inside place (donut-shaped region 35*a*) close to background region 34 in circular region 35 becomes the intermediate color between gray and black.

As can be seen from the parts (a1) to (a3) of FIG. 6, with reducing black region, the bright flare around the black region and the shadow at oblique viewing (parallax problem) become more conspicuous. Thus, when an area of the black spot is reduced, it is understood that the parallax countermeasure amount is preferably increased.

A part (b1) of FIG. 6 illustrates a display example when white is displayed in right-half region 41 on a gray background (left-half region 40) using the conventional liquid crystal display panel having the two-plate structure. In this case, the inclined portion (that is, the gradation place) of the first video signal is shifted to lower-luminance left-half region 40 due to the parallax countermeasure using the maximum value filter, so that a place close to right-half region 41 (longitudinal region 40*a*) in left-half region 40 becomes the intermediate color between gray and white.

A part (b2) of FIG. 6 illustrates a display example when white is displayed in relatively large circular region 43 on a gray background (background region 42) using the conventional liquid crystal display panel having the two-plate structure. In this case, the inclined portion (that is, the gradation place) of the first video signal is shifted to the inside of lower-luminance circular region 42 (that is, an outer circumferential side of circular region 43) due to the parallax countermeasure using the maximum value filter, so that a place (donut-shaped region 42*a*) close to circular region 43 in background region 42 becomes the intermediate color between gray and white.

A part (b3) of FIG. 6 illustrates a display example when white is displayed in relatively small circular region 45 on a gray background (background region 44) using the conventional liquid crystal display panel having the two-plate structure. In this case, the inclined portion (that is, the gradation place) of the first video signal is shifted to the lower-luminance circular region 44 (that is, an outer circumferential side of circular region 45) due to the parallax countermeasure using the maximum value filter, so that a place (donut-shaped region 44*a*) close to circular region 45 in background region 44 becomes the intermediate color between gray and white.

As can be seen from the parts (b1) to (b3) of FIG. 6, with reducing white region, the bright flare around the white region become more conspicuous. Thus, when the area of the bright spot is reduced, it is understood that the parallax countermeasure amount is preferably decreased.

Figure 7:
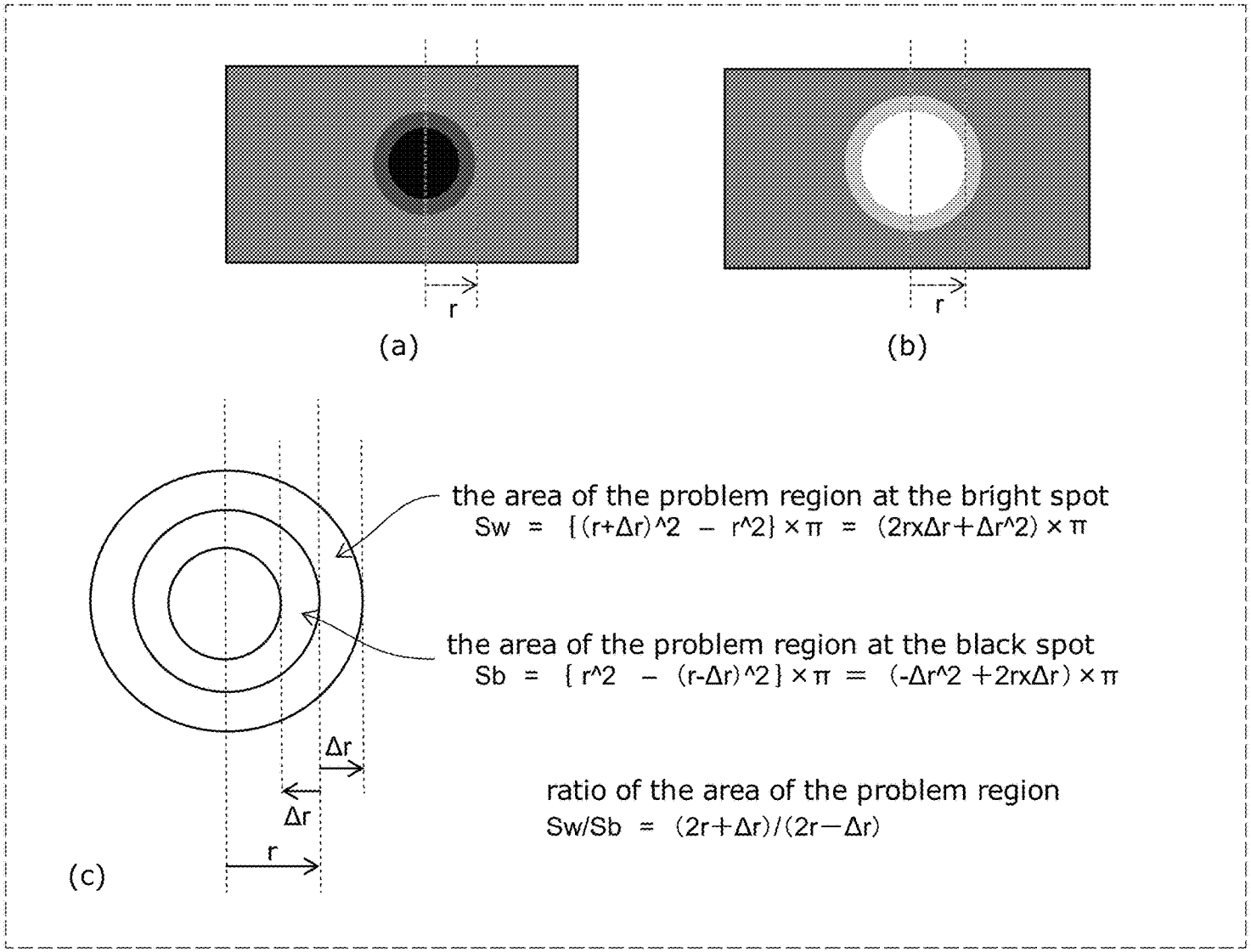
FIG. 7 is a view illustrating the size of the problem region that can be generated with respect to the bright spot and the black spot due to the two-plate structure of the conventional liquid crystal display panel.

FIG. 7 is a view illustrating the size of the problem region that can be generated with respect to the bright spot and the black spot due to the two-plate structure of the conventional liquid crystal display panel. A part (a) of FIG. 7 is a view illustrating the black spot having radius r. A part (b) of FIG. 7 is a view illustrating the bright spot having identical radius r. A part (c) of FIG. 7 is a view illustrating the area of the problem region in each of the parts (a) and (b) of FIG. 7.

As illustrated in the part (c) of FIG. 7, when the area ("the area of the problem region at the bright spot") of the difference between the circle having radius r and the circle expanded outward from the circle by Ar is compared to the area ("the area of the problem region at the black spot") of the difference between the circle having radius r and the circle reduced from the circle by Ar, clearly the area outside the circle becomes larger (see a "ratio of the area of the problem region"). That is, when the black regions of the image including the black spot and the image including the bright spot are expanded using the maximum value filter having the identical size, the problem region becomes wider in the bright spot where the black region spreads outside the circle as compared with the black spot where the black region is spread inside the circle.

As described above with reference to FIG. 5, the region relating to the increase in white area in the first video signal is decided according to the size of the maximum value filter. That is, the region of the increase in white area in the first video signal is enlarged with increasing size of the maximum value filter. As described with reference to FIGS. 6 and 7, the bright spot is larger than the black spot in the problem region.

These mean that, when the size of the maximum value filter is decided by a method of minimizing the problem region based on the bright spot, application of the identical maximum value filter to the black spot means that the size of the maximum value filter is too small. In other words, the size of the maximum value filter corresponding to the differential value of the black-and-white step is set relatively small when the display target is the bright spot, and the size of the maximum value filter for the identical differential value is set relatively large when the display target is the black spot.

As described above, in the exemplary embodiment, liquid crystal display device 10 decides the size of the maximum value filter corresponding to the differential value of the black-and-white step by the method of minimizing the problem region based on the bright spot, and sets the size of the maximum value filter larger even with the identical differential value when the display target is the black spot. That is, the first video signal subjected to the parallax countermeasure amount different between the bright spot and the black spot is generated. An operation (that is, a video signal processing method) of liquid crystal display device 10 of the exemplary embodiment having these characteristics will be described below.

Figure 8:
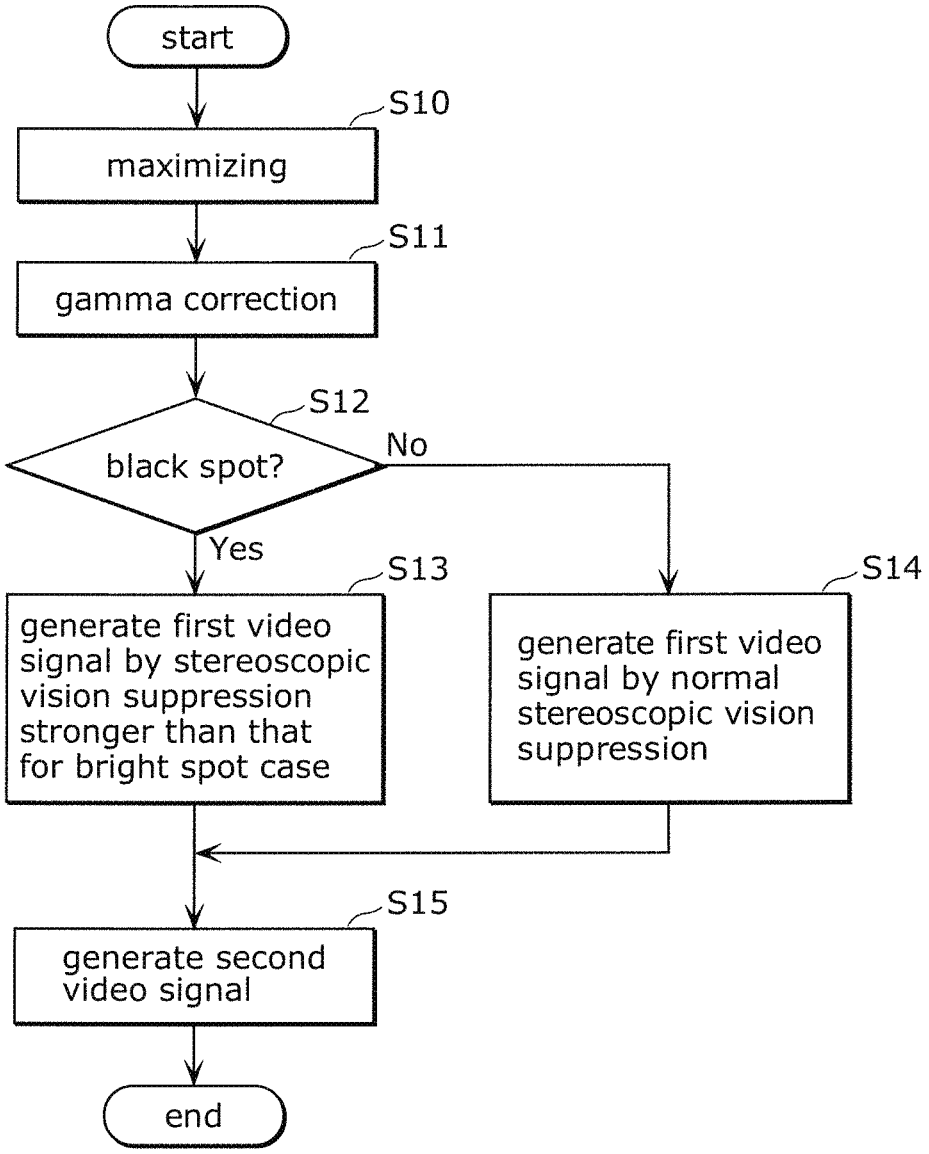
FIG. 8 is a flowchart illustrating the operation of liquid crystal display device according to the exemplary embodiment.

FIG. 8 is a flowchart illustrating the operation of liquid crystal display device 10 of the exemplary embodiment. Signal processing of signal processor 20 included in liquid crystal display device 10 is illustrated in FIG. 8.

Maximum value processor 21 extracts the maximum value from the gradation values of the three color components included in the input video signal (S10). Specifically, maximum value processor 21 selects and outputs the maximum value of the gradation value (R value, G value, B value) for each pixel with respect to the video signal.

Gamma corrector 25 performs the gamma correction on the video signal output from maximum value processor 21 (S11). For example, gamma corrector 25 converts the gradation value using the look-up table indicating the gamma characteristic emphasizing the contrast of the video displayed on liquid crystal display device 10 as illustrated in FIG. 4.

Subsequently, black-spot and bright-spot detector 23 detects whether the video signal output from maximum value processor 21 indicates the black spot (S12). As a result, when black-spot and bright-spot detector 23 detects that the video signal indicates the black spot (Yes in S12), stereoscopic vision suppressor 24 performs the stereoscopic vision suppression processing on the video signal output from gamma corrector 25 with the intensity higher than that in the case where the bright spot is detected under the control of black-spot and bright-spot detector 23, and outputs the video signal as the first video signal (S13). Specifically, black-spot and bright-spot detector 23 instructs threshold processor 24*c* of stereoscopic vision suppressor 24 to change the threshold. At this time, when detecting the black spot, black-spot and bright-spot detector 23 instructs threshold processor 24*c* of stereoscopic vision suppressor 24 to change the threshold such that the maximum value filter having the larger size than the case where the bright spot is detected is used in size variable maximum value filter 24*d* of stereoscopic vision suppressor 24, so that size variable maximum value filter 24*d* replaces the gradation value of the pixel indicated by the video signal output from gamma corrector 25 with the maximum value among the gradation values of the pixel and the plurality of pixels adjacent to the pixel using the larger-size maximum value filter instructed by threshold processor 24*c*. The video signal output from size variable maximum value filter 24*d* is spatially smoothed by second low-pass filter 24*e*, and output as the first video signal. Consequently, the first video signal subjected to the stereoscopic vision suppression processing stronger than that in the case where the bright spot is detected is generated when the black spot is detected.

On the other hand, when black-spot and bright-spot detector 23 does not detect that the video signal indicates the black spot (No in S12), stereoscopic vision suppressor 24 performs the stereoscopic vision suppression processing on the video signal output from gamma corrector 25 with normal intensity under the control of black-spot and bright-spot detector 23, and outputs the video signal as the first video signal (S14). Specifically, because black-spot and bright-spot detector 23 does not instruct threshold processor 24*c* of stereoscopic vision suppressor 24 to change the threshold, size variable maximum value filter 24*d* replaces the gradation value of the pixel indicated by the video signal output from gamma corrector 25 with the maximum value among the gradation values of the pixel and the plurality of pixels adjacent to the pixel using the normal-size maximum value filter (in the exemplary embodiment, the maximum value filter having the size decided by the method of minimizing the problem region based on the bright spot). The video signal output from size variable maximum value filter 24*d* is spatially smoothed by second low-pass filter 24*e*, and output as the first video signal. Consequently, the first video signal subjected to the stereoscopic vision suppression processing with the normal intensity is generated when the black spot is not detected.

Finally, second video signal generator 26 generates the second video signal for the second liquid crystal display panel 14 disposed on the display surface side using the first video signal output from stereoscopic vision suppressor 24 (S15). Specifically, through the processing using inverse gamma corrector 26*a* and multiplier 26*b*, second video signal generator 26 generates the gradation value obtained by dividing the input video signal by the gradation value of the second video signal as the second video signal by multiplying the input video signal by the value obtained by performing the inverse gamma correction on the first video signal.

Figure 9:
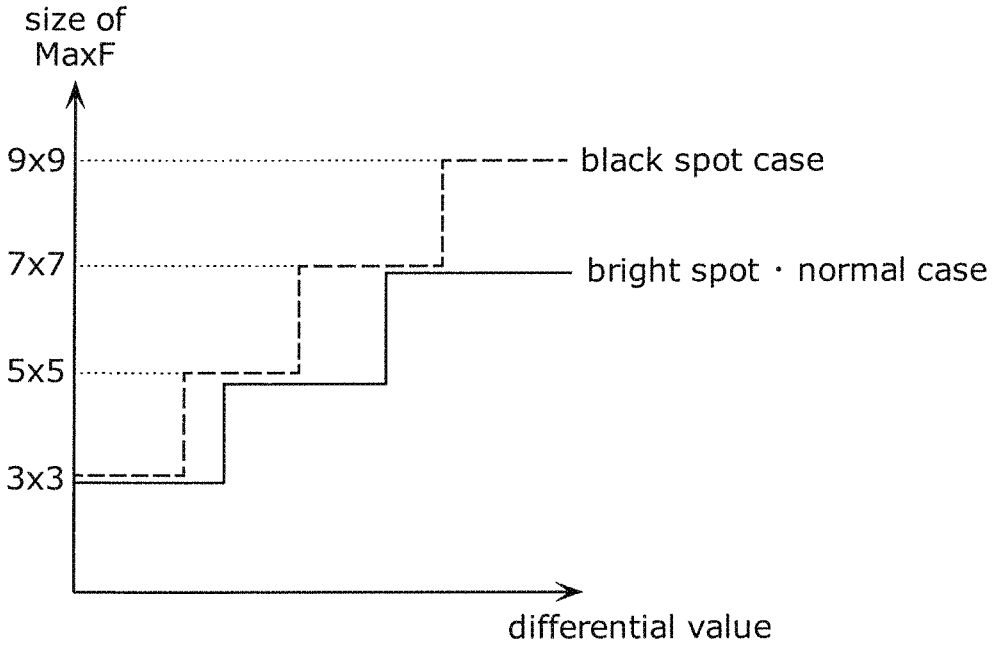
FIG. 9 is a view illustrating a specific processing example of threshold processor used in the video signal processing method illustrated in the flowchart of FIG. 8.

FIG. 9 is a view illustrating a specific processing example of threshold processor 24*c* used in the video signal processing method illustrated in the flowchart of FIG. 8. The horizontal axis indicates the differential value input from maximum value filter 24*b* to threshold processor 24*c*. The vertical axis indicates the size on which threshold processor 24*c* instructs size variable maximum value filter 24*d*. A solid line indicates a relationship between the input value (that is, the derivative value) and the output value (that is, the size of the maximum value filter) that are used in threshold processor 24*c* when the instruction in which the bright spot is detected is received from black-spot and bright-spot detector 23 (in the exemplary embodiment, the instruction includes the cases except for the reception of the instruction in which the black spot is detected (that is, the normal case)). A broken line indicates the relationship between the input value (that is, the differential value) and the output value (that is, the size of the maximum value filter) that are used in threshold processor 24*c* when the instruction in which the black spot is detected is received from black-spot and bright-spot detector 23.

Threshold processor 24*c* holds a table specifying two types of the relationships in FIG. 9. When the instruction in which the black spot is detected is received from black-spot and bright-spot detector 23, the size of the maximum value filter corresponding to the differential value input from maximum value filter 24*b* is specified by referring to the relationship indicated by the broken line, and instructs size variable maximum value filter 24*d* on the specified size. On the other hand, when other instructions are received from black-spot and bright-spot detector 23, the size of the maximum value filter corresponding to the differential value input from maximum value filter 24*b* is specified by referring to the relationship indicated by the solid line, and instructs size variable maximum value filter 24*d* on the specified size. Consequently, when black-spot and bright-spot detector 23 detects that the video signal indicates the black spot (Yes in S12), stereoscopic vision suppressor 24 performs the stereoscopic vision suppression processing on the video signal output from gamma corrector 25 with the intensity higher than that in the case where the bright spot is detected (in the exemplary embodiment, other cases except for the detection of the black spot), and outputs the video signal as the first video signal. As a result, the parallax problem caused by the two-plate structure of the liquid crystal display panel can appropriately be lessened whether the input video signal indicates the bright spot or the black spot.

Figure 10:
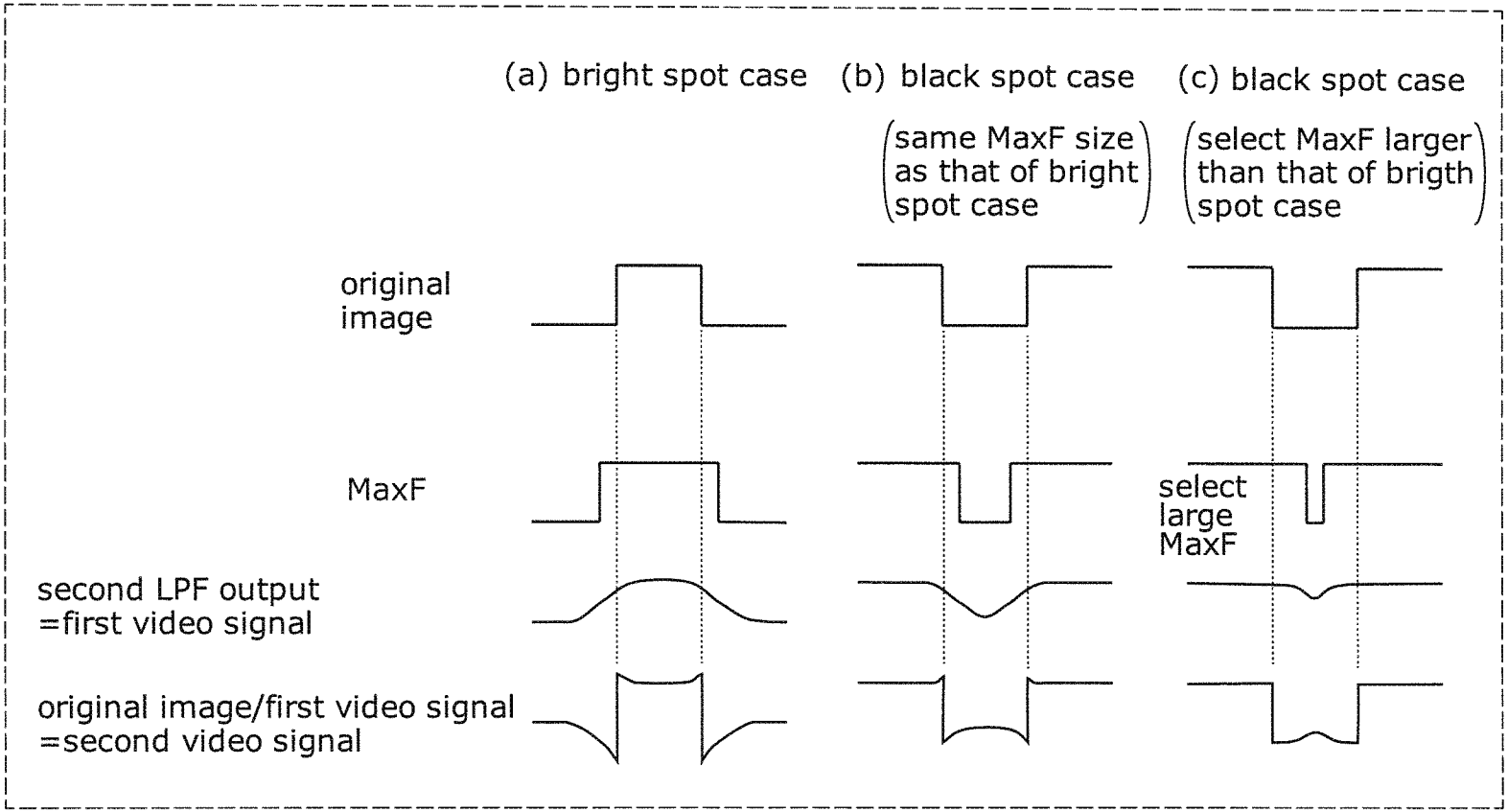
FIG. 10 is a view illustrating examples of a processing result of liquid crystal display device according to the exemplary embodiment and a processing result of a conventional technique.

FIG. 10 is a view illustrating examples of a processing result (parts (a) and (c) of FIG. 10) of liquid crystal display device 10 according to the exemplary embodiment and a processing result (a part (b) of FIG. 10) of a reference example (conventional technique). Parts (a), (b), and (c) of FIG. 10 illustrate examples of the processing results of the bright spot, the black spot (the case of the use of the maximum value filter having the same size as the bright spot), and the black spot (the case of the use of the maximum value filter having the size larger than that of the bright spot), respectively. The luminance distributions of the original image, the output of MaxF (size variable maximum value filter 24*d*), the output of the second LPF (second low-pass filter 24*e*), and the result (that is, the second video signal) in which the original image is divided by the first video signal are illustrated from the top to the bottom in the parts (a) to (c) of FIG. 10.

As can be seen from the part (a) of FIG. 10, in the liquid crystal display device of the exemplary embodiment, when the first video signal and the second video signal are superimposed on each other for the bright spot, the inclined portion of the first video signal hardly exists in the bright spot, and the parallax problem is suppressed.

As can be seen from the part (b) in FIG. 10, in the conventional liquid crystal display device, when the first video signal and the second video signal superimposed on each other for the black spot, the inclined portion of the first video signal is located inside the black spot, causing the parallax problem.

As can be seen from the part (c) of FIG. 10, in the liquid crystal display device of the exemplary embodiment, the first video signal and the second video signal are superimposed on each other for the black spot, the inclined portion of the first video signal hardly exists inside the black spot, and the parallax problem is suppressed.

As described above, liquid crystal display device 10 of the exemplary embodiment is a device that displays the input video signal, and liquid crystal display device 10 includes: first liquid crystal display panel 12 and second liquid crystal display panel 14 disposed to be laminated; first video signal generator 22 that generates the first video signal for first liquid crystal display panel 12 by performing the stereoscopic vision suppression processing of suppressing the stereoscopic vision due to the parallax on the video signal; and second video signal generator 26 that generates the second video signal for second liquid crystal display panel 14 using the first video signal. When the video signal indicates the black spot, first video signal generator 22 performs the stereoscopic vision suppression processing with intensity different from that in the case where the video signal indicates the bright spot.

The video signal processing method of the exemplary embodiment is a video signal processing method performed by liquid crystal display device 10 including first liquid crystal display panel 12 and second liquid crystal display panel 14 disposed to be laminated, and the video signal processing method includes: first video signal generating steps S13 and S14 of generating the first video signal for the first liquid crystal display panel 12 by performing the stereoscopic vision suppression processing of suppressing the stereoscopic vision due to the parallax on the input video signal; and second video signal generating step S15 of generating the second video signal for second liquid crystal display panel 14 using the first video signal generated in first video signal generating steps S13 and S14. In first video signal generating step S13, when the video signal indicates the black spot (Yes in S12), the stereoscopic vision suppression processing is performed with intensity different from that in the case where the video signal indicates the bright spot.

Consequently, the first video signal subjected to the stereoscopic vision suppression processing with the intensity different from that in the case where the video signal indicates the bright spot is generated when the input video signal indicates the black spot. In this case, the parallax difference that the problem region caused by the parallax is enlarged in the bright spot as compared with the black spot is suppressed, and therefore the parallax problem caused by the two-plate structure of the liquid crystal display panel can appropriately be lessened properly even if the display target is the bright spot or the black spot.

First video signal generator 22 includes: gamma corrector 25 that performs the gamma correction on the input video signal; stereoscopic vision suppressor 24 that generates the first video signal by performing the stereoscopic vision suppression processing on the video signal output from gamma corrector 25; and black-spot and bright-spot detector 23 that detects whether the video signal indicates the black spot or the bright spot, and when detecting the black spot, controls stereoscopic vision suppressor 24 to perform the stereoscopic vision suppression processing with intensity higher than that in the case where the video signal indicates the bright spot. Consequently, the intensity of the stereoscopic vision suppression processing is appropriately controlled based on the black spot or the bright spot detected by black-spot and bright-spot detector 23.

Stereoscopic vision suppressor 24 includes size variable maximum value filter 24*d* that replaces the gradation value of the pixel indicated by the video signal with the maximum value in the gradation values of the pixel and the plurality of pixels adjacent to the pixel, and when detecting the black spot, black-spot and bright-spot detector 23 controls size variable maximum value filter 24*d* to replace the gradation value of the pixel indicated by the video signal with the maximum value while the number of the plurality of adjacent pixels is increased as compared with the case where the bright spot is detected. Consequently, the size of the maximum value filter used by size variable maximum value filter 24*d* is changed depending on the detection result of black-spot and bright-spot detector 23, and the parallax problem depending on the bright spot and the black spot is appropriately suppressed.

Stereoscopic vision suppressor 24 further includes second low-pass filter 24*e* that generates the first video signal by spatially smoothing the gradation value indicated by the video signal output from size variable maximum value filter 24*d*. Consequently, second low-pass filter 24*e* obtains the first video signal in which the luminance is gradually changed, so that the parallax problem caused by the two-plate structure of the liquid crystal display panel can be suppressed.

Second video signal generator 26 generates the second video signal by multiplying the video signal by the value obtained by performing the inverse gamma correction on the first video signal. Consequently, because the gradation value obtained by dividing the input video signal by the gradation value of the second video signal is generated as the second video signal, the result obtained by multiplying the gradation value of the first video signal by the gradation value of the second video signal is matched with the gradation value of the input original video signal, and the luminance characteristic of the input original video signal is reproduced when the first liquid crystal display panel 12 and the second liquid crystal display panel 14 are viewed in the overlapping manner.

Liquid crystal display device 10, further includes maximum value processor 21 that extracts the maximum value from the gradation values of three color components included in the video signal. The video signal includes the gradation values of the three color components, and first video signal generator 22 performs the stereoscopic vision suppression processing on the maximum value extracted by the maximum value processor 21. Consequently, the simple process of maximizing the three color components generates the black-and-white video signal necessary for high contrast from the color video signal.

The method for generating the first video signal by changing the intensity of the stereoscopic vision suppression processing according to whether the input video signal indicates the black spot or the bright spot is not limited to the exemplary embodiment.

Figure 11:
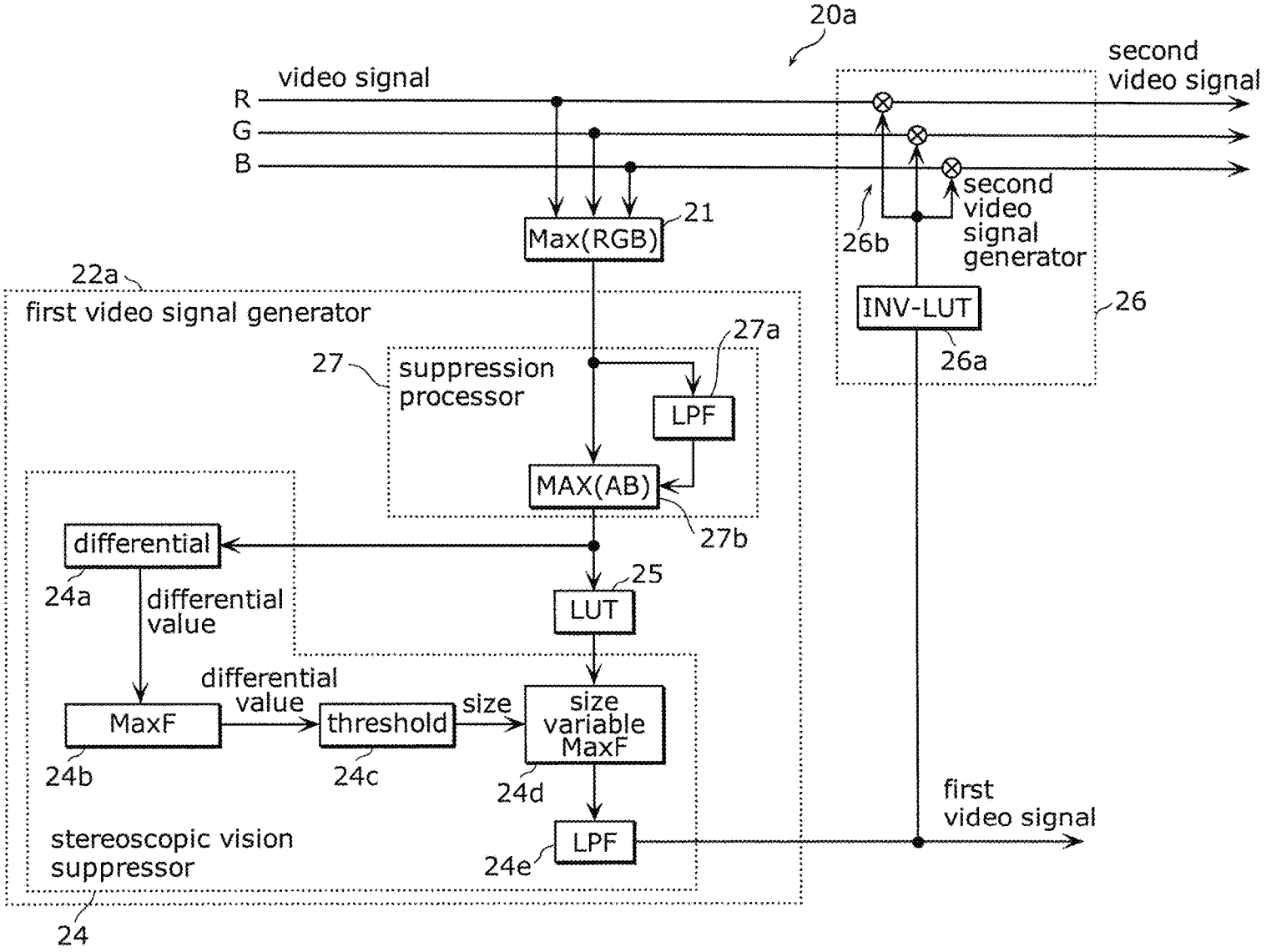
FIG. 11 is a block diagram illustrating a configuration of signal processor according to a modification of the exemplary embodiment.

FIG. 11 is a block diagram illustrating a configuration of signal processor 20*a* according to a modification of the exemplary embodiment. Signal processor 20*a* of the modification includes first video signal generator 22*a* of the modification instead of first video signal generator 22 in signal processor 20 of the exemplary embodiment.

First video signal generator 22*a* is identical to first video signal generator 22 of the exemplary embodiment in the circuit that generates the first video signal for first liquid crystal display panel 12 disposed on the back surface side using the corrected video signal output from gamma corrector 25. However, first video signal generator 22*a* is different from first video signal generator 22 of the exemplary embodiment but differs in that first video signal generator 22*a* includes suppression processor 27 instead of black-spot and bright-spot detector 23 of the exemplary embodiment. A difference from the exemplary embodiment will mainly be described.

Suppression processor 27 is a circuit that suppresses the fluctuation range of the gradation value indicated by the video signal than in the case where the video signal indicates the bright spot when the video signal output from maximum value processor 21 indicates the black spot. Suppression processor 27 includes first low-pass filter (LPF) 27*a* that spatially smoothes the gradation value indicated by the video signal output from maximum value processor 21 and maximum value selector (Max(AB)) 27*b* that selects and outputs larger one of the gradation values of the video signal output from maximum value processor 21 and the filtered video signal obtained by performing the processing of first low-pass filter 27*a*. For example, first low-pass filter 27*a* replaces the gradation value of the pixel with the average value of the gradation values of the pixel and the peripheral pixels of the pixel (for example, the total of nine pixels including the pixel and eight peripheral pixels).

Threshold processor 24*c* of stereoscopic vision suppressor 24 of the modification basically has the same function as that of the exemplary embodiment. However, because the instruction relating to the threshold change is not received from the outside unlike the exemplary embodiment, size variable maximum value filter 24*d* is instructed on the size of the maximum value filter used in size variable maximum value filter 24*d* according to the differential value output from maximum value filter 24*b* using the fixed threshold. For example, the fixed threshold is a value indicated by the solid line in FIG. 9 (that is, the relationship between the input value (that is, the differential value) and the output value (that is, the size of the maximum value filter) that are decided by the method for minimizing the problem region based on the black spot).

Figure 12A:
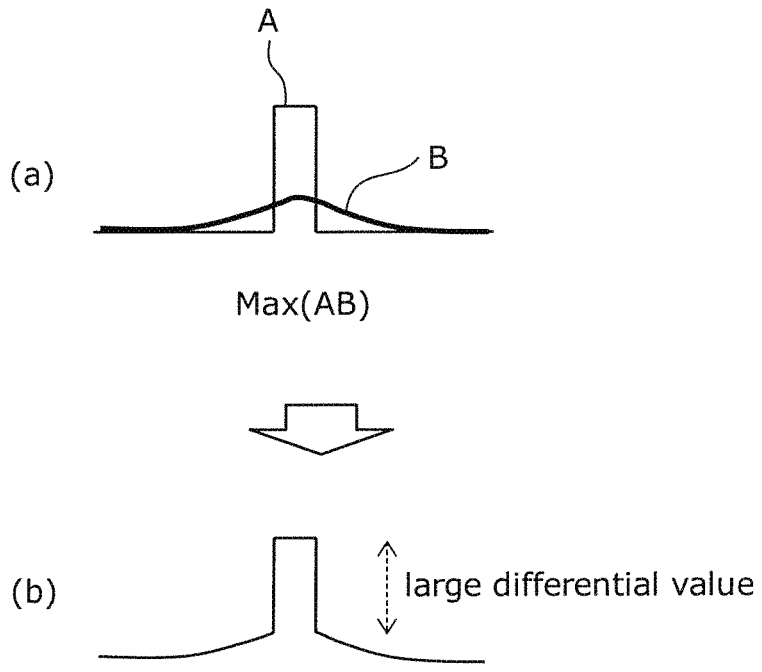
FIG. 12A is a view illustrating processing performed by suppression processor in FIG. 11 on the bright spot.

FIG. 12A is a view illustrating processing performed by suppression processor 27 in FIG. 11 on the bright spot. A part (a) of FIG. 12A illustrates luminance distribution A of the video signal input to suppression processor 27 and luminance distribution B of the video signal output from first low-pass filter 27*a*. A part (b) of FIG. 12A illustrates the luminance distribution of the video signal output from maximum value selector 27*b*.

As can be seen from FIG. 12A, suppression processor 27 selects and outputs larger one of the gradation values of the input video signal and the filtered video signal obtained by smoothing the input video signal using first low-pass filter 27*a* when the video signal indicating the bright spot is input, so that suppression processor 27 outputs the video signal in which the fluctuation width of the gradation value indicated by the input video signal is slightly suppressed (that is, almost no suppression) as illustrated in the part (b) of FIG. 12A. As described above, because the video signal output from suppression processor 27 with respect to the bright spot has the larger differential value in the black-and-white step as compared with the case of the black spot in FIG. 12B, the maximum value filter having the size larger than that of the black spot is used in size variable maximum value filter 24*d* of stereoscopic vision suppressor 24.

Figure 12B:
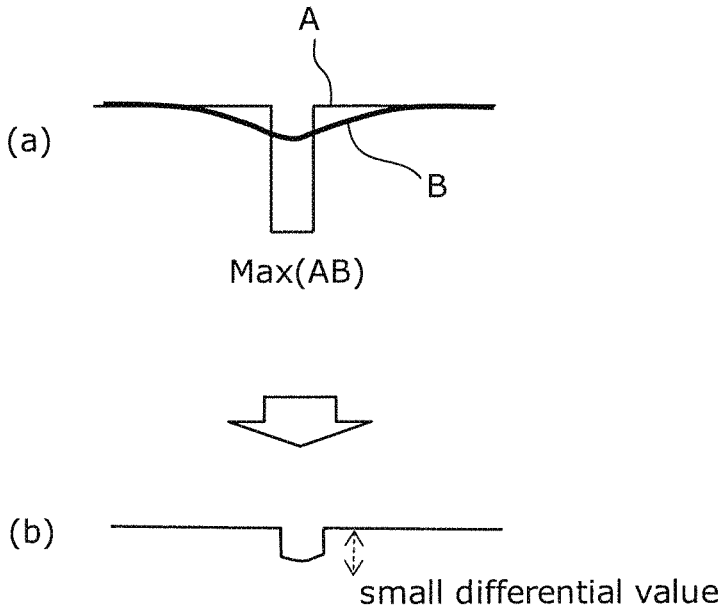
FIG. 12B is a view illustrating processing performed by suppression processor in FIG. 11 on the black spot.

FIG. 12B is a view illustrating processing performed by suppression processor 27 in FIG. 11 on the black spot. A part (a) of FIG. 12B illustrates luminance distribution A of the video signal input to suppression processor 27 and luminance distribution B of the video signal output from first low-pass filter 27*a*. A part (b) of FIG. 12B illustrates the luminance distribution of the video signal output from maximum value selector 27*b*.

As can be seen from FIG. 12B, suppression processor 27 selects and outputs larger one of the gradation values of the input video signal and the filtered video signal obtained by smoothing the input video signal using first low-pass filter 27*a* when the video signal indicating the black spot is input, so that suppression processor 27 outputs the video signal in which the fluctuation width of the gradation value indicated by the input video signal is largely suppressed (that is, suppressed more than a degree of suppression for the bright spot) as illustrated in the part (b) of FIG. 12B. As described above, because the video signal output from suppression processor 27 with respect to the black spot has the smaller differential value in the black-and-white step as compared with the case of the bright spot in FIG. 12A, the maximum value filter having the size smaller than that of the bright spot is used in size variable maximum value filter 24*d* of stereoscopic vision suppressor 24.

Figure 13:
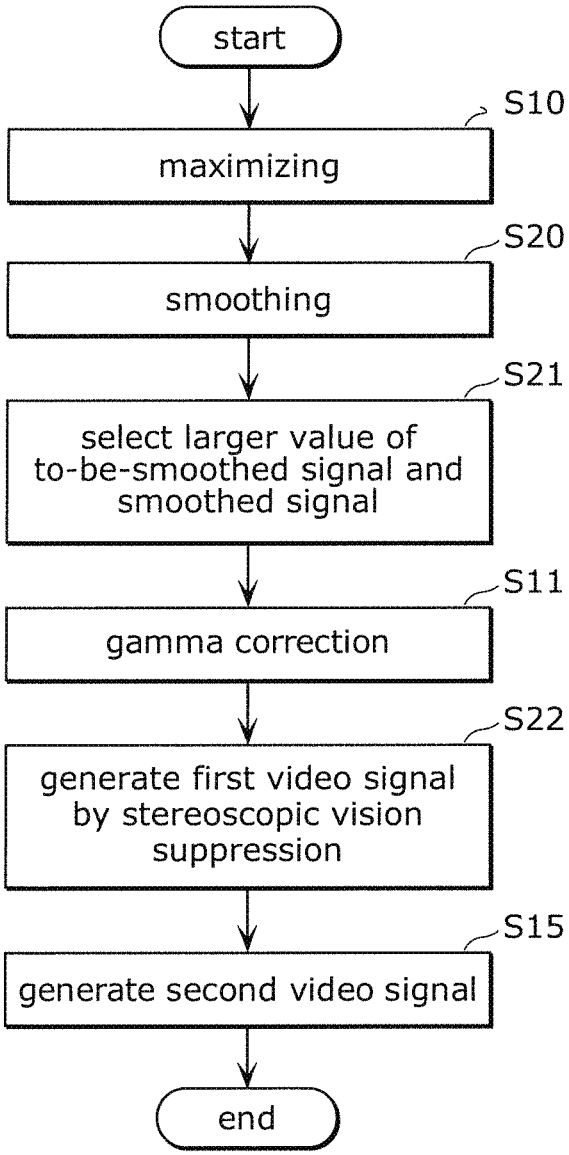
FIG. 13 is a flowchart illustrating the operation of liquid crystal display device according to a modification of the exemplary embodiment.

FIG. 13 is a flowchart illustrating the operation (that is, the video signal processing method) of liquid crystal display device of the modification. Signal processing of signal processor 20*a* included in the liquid crystal display device of the modification is illustrated in FIG. 13. A difference from the exemplary embodiment in FIG. 8 will mainly be described.

When the processing (S10) of maximum value processor 21 is completed, first low-pass filter 27*a* of suppression processor 27 spatially smoothes the gradation value indicated by the video signal output from maximum value processor 21 (S20).

Maximum value selector 27*b* of suppression processor 27 selects and outputs larger one of the gradation values of the video signal (that is, the pre-smoothing signal) output from maximum value processor 21 and the filtered video signal (that is, the smoothed signal) obtained by performing the processing of first low-pass filter 27*a* (S21).

Subsequently, gamma corrector 25 performs the gamma correction on the video signal output from suppression processor 27 (S11). Stereoscopic vision suppressor 24 performs the stereoscopic vision suppression processing on the video signal output from gamma corrector 25 using the video signal output from suppression processor 27, and outputs the video signal as the first video signal (S22).

Finally, second video signal generator 26 generates the second video signal for the second liquid crystal display panel 14 disposed on the display surface side using the first video signal output from stereoscopic vision suppressor 24 (S15).

Figure 14:
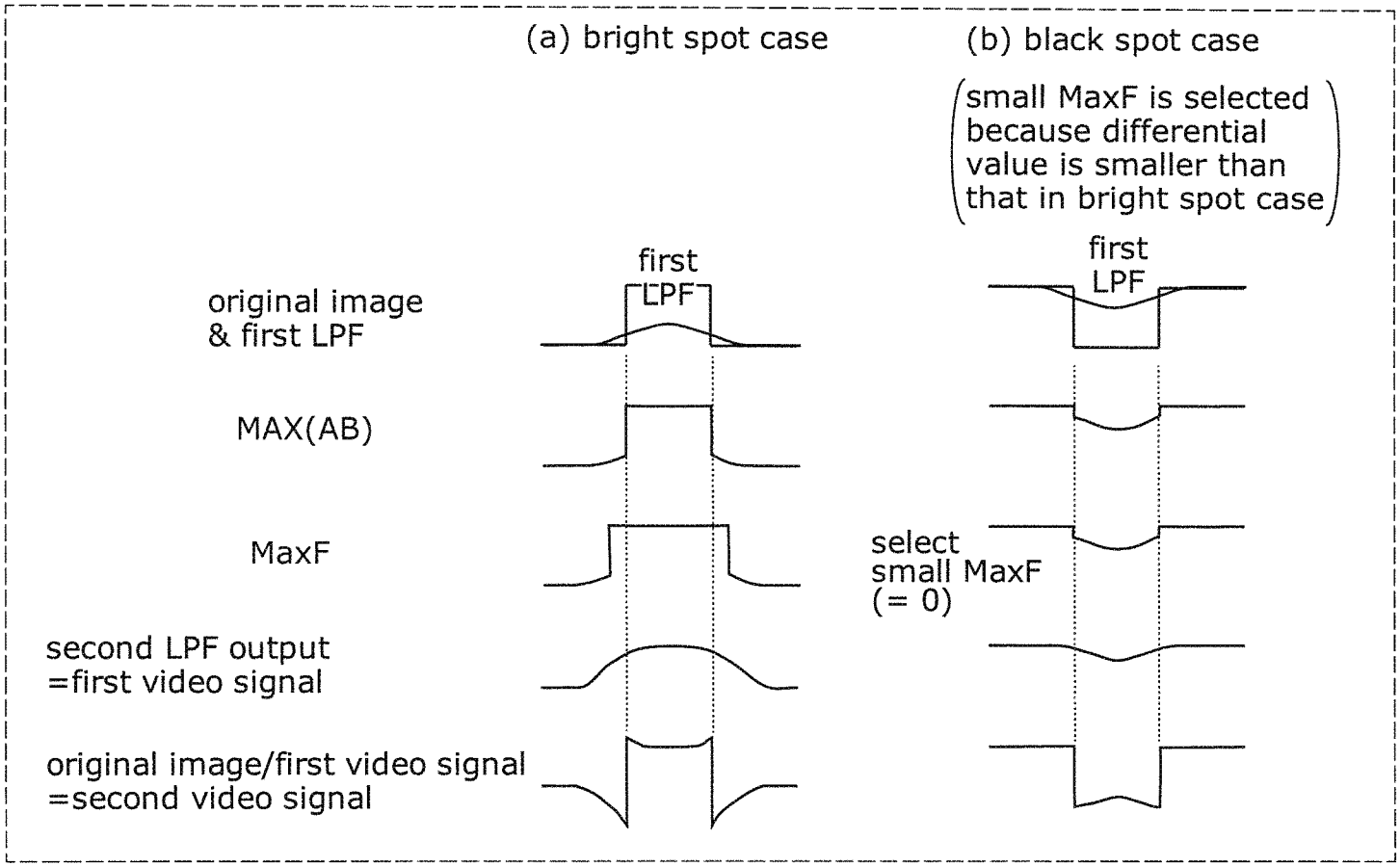
FIG. 14 is a view illustrating an example of the result of the processing performed by the liquid crystal display device according to a modification of the exemplary embodiment.

FIG. 14 is a view illustrating an example of the result of the processing performed by the liquid crystal display device of the modification. Parts (a) and (b) in FIG. 14 illustrate examples of the processing results for the bright spot and the black spot (in this case, the maximum value filter having the smaller size is used because the differential value is smaller than the bright spot), respectively. The luminance distributions of the original image, the output of the first LPF (first low-pass filter 27*a*), the output of Max(AB) (maximum value selector 27*b*), the output of MaxF (size variable maximum value filter 24*d*), the output (that is, the first video signal) of the second LPF (second low-pass filter 24*e*), and the result (that is, the second video signal) in which the original image is divided by the first video signal are illustrated from the top to the bottom in the parts (a) and (b) of FIG. 14.

As can be seen from the part (a) of FIG. 14, similarly to the exemplary embodiment in the part (a) of FIG. 10, when the first video signal and the second video signal are superimposed on each other for the bright spot, the inclined portion of the first video signal hardly exists in the bright spot, and the parallax problem is suppressed.

As can be seen from the part (b) of FIG. 14, similarly to the exemplary embodiment in the part (c) of FIG. 10, when the first video signal and the second video signal are superimposed on each other for the black spot, the inclined portion of the first video signal hardly exists in the black spot, and the parallax problem is suppressed.

As described above, when the input video signal indicates the black spot, first video signal generator 22*a* of the modification includes suppression processor 27 that suppresses the fluctuation width of the gradation value indicated by the input video signal as compared with the case where the input video signal indicates the bright spot. Consequently, when the display target is the black spot, the differential value in the black-and-white step becomes smaller than that in the case where the display target is the bright spot, and stereoscopic vision suppressor 24 performs the stereoscopic vision suppression processing using the maximum value filter having the small size, almost no inclined portion of the first video signal exists inside the black spot similarly to the exemplary embodiment, and the parallax problem is suppressed.

Suppression processor 27 includes: first low-pass filter 27*a* that spatially smoothes the gradation value indicated by the video signal with respect to the video signal; and maximum value selector 27*b* that selects and outputs the video signal having the larger gradation value in the video signal and the filtered video signal obtained by performing processing on the video signal using first low-pass filter 27*a*. Consequently, a circuit in which the difference between the bright spot and the black spot is reflected in the decision of the differential value in the black-and-white step, namely, the size of the maximum value filter is fabricated by a simple circuit without determining the bright spot or the black spot.

First video signal generator 22*a* further includes: gamma corrector 25 that performs the gamma correction on the video signal output from suppression processor 27; size variable maximum value filter 24*d* that replaces the gradation value of the pixel indicated by the video signal with the maximum value among the gradation values of the pixel and the plurality of pixels adjacent to the pixel with respect to the video signal output from gamma corrector 25; and second low-pass filter 24*e* that generates the first video signal by spatially smoothing the gradation value indicated by the video signal output from size variable maximum value filter 24*d*. Consequently, the size of the maximum value filter used in the stereoscopic vision suppression processing is changed depending on the processing result (that is, the differential value in the black-and-white step) of suppression processor 27, and the parallax problem depending on the black spot and the bright spot is properly suppressed.

The liquid crystal display device and the video signal processing method of the present disclosure is described above based on the exemplary embodiment and the modification. However, the present disclosure is not limited to the exemplary embodiment and the modification. It is understood that various changes of the exemplary embodiment and the modification that are conceived by those skilled in the art, and other exemplary embodiments obtained by a combination of components of the exemplary embodiment and the modification are also included within the scope of the present disclosure.

For example, in the exemplary embodiment and the modification, the input video signal is the color signal including the R value, the G value, and the B value. However, the input video signal is not limited to such a type of signal. The input video signal may be a color difference signal including Y, Cb, and Cr or a black-and-white signal. First video signal generators 22 and 22*a* of the exemplary embodiment and the modification perform processing on the black-and-white signal converted from the input video signal, so that the processing can be performed without depending on the type of the input video signal.

In the exemplary embodiment, threshold processor 24*c* does not distinguish the bright spot and the image other than bright spot from each other in the processing when the display target is not the black spot. Alternatively, threshold processor 24*c* may distinguish the bright spot and the image other than bright spot from each other. That is, a third curve indicating a relationship in the normal case where the display target is neither the black spot nor the bright spot may be added as a curve indicating the relationship between the differential value and the size of the maximum value filter, the curve being used by threshold processor 24*c*. In addition to the detection of the bright spot and the black spot, black-spot and bright-spot detector 23 also detects that the display target is neither the bright spot nor the black spot, and instructs threshold processor 24*c* on the detection result. Consequently, the highly functional liquid crystal display device in which the parallax countermeasure amount is appropriately decided according to the three types of the cases where the display target is the bright spot, the black spot, and other images is constructed.

The present disclosure can be used as the liquid crystal display device including the two liquid crystal display panels disposed to be laminated, particularly as the liquid crystal display device in which the parallax problem caused by the two-plate structure of the liquid crystal display panel is appropriately lessened irrespective of whether the display target is the bright spot or the black spot, for example, as a liquid crystal display device that displays a medical image.

What is claimed is:

1. A liquid crystal display device that displays an input video signal, the liquid crystal display device comprising:

a first liquid crystal display panel and a second liquid crystal display panel disposed to be laminated;

a first video signal generator that generates a first video signal for the first liquid crystal display panel by performing stereoscopic vision suppression processing of suppressing stereoscopic vision due to parallax on the video signal; and a second video signal generator that generates a second video signal for the second liquid crystal display panel using the first video signal, wherein the first video signal generator includes a suppression processor that suppresses a fluctuation range of a gradation value indicated by the video signal when the video signal indicates a bright spot that is different than when the video signal indicates a black spot.

2. The liquid crystal display device according to claim 1, wherein the suppression processor includes:

a first low-pass filter that spatially smoothes the gradation value indicated by the video signal with respect to the video signal; and a maximum value selector that selects and outputs the video signal having the larger gradation value in the video signal and the filtered video signal obtained by performing processing on the video signal using the first low-pass filter.

3. The liquid crystal display device according to claim 1, wherein the first video signal generator further includes:

a gamma corrector that performs gamma correction on the video signal output from the suppression processor;

a maximum value filter that replaces the gradation value of a pixel indicated by the video signal with a maximum value among the gradation values of the pixel and a plurality of pixels adjacent to the pixel with respect to the video signal output from the gamma corrector; and a second low-pass filter that generates the first video signal by spatially smoothing the gradation value indicated by the video signal output from the maximum value filter.

4. The liquid crystal display device according to claim 1, wherein the second video signal generator generates the second video signal by multiplying the video signal by a value obtained by performing inverse gamma correction on the first video signal.

5. The liquid crystal display device according to claim 1, further comprising a maximum value processor that extracts a maximum value from the gradation values of three color components included in the video signal, wherein the video signal includes the gradation values of the three color components, and the first video signal generator performs the stereoscopic vision suppression processing on the maximum value extracted by the maximum value processor.

6. The liquid crystal display device according to claim 1, further comprising a maximum value processor that extracts a maximum value from the gradation values of three color components included in the video signal, wherein the first video signal generator suppresses a fluctuation range of the gradation value indicated by the video signal as compared to when the video signal indicates a bright spot when the video signal output from the maximum value processor indicates a black spot.

7. A liquid crystal display device that displays an input video signal, the liquid crystal display device comprising:

a first liquid crystal display panel and a second liquid crystal display panel disposed to be laminated;

a first video signal generator that generates a first video signal for the first liquid crystal display panel by performing stereoscopic vision suppression processing of suppressing stereoscopic vision due to parallax on the video signal; and a second video signal generator that generates a second video signal for the second liquid crystal display panel using the first video signal, wherein the first video signal generator includes:

a gamma corrector that performs gamma correction on the video signal;

a stereoscopic vision suppressor that generates the first video signal by performing the stereoscopic vision suppression processing on the video signal output from the gamma corrector; and a black-spot and bright-spot detector that detects whether the video signal indicates the black spot or the bright spot, and when detecting the black spot, controls the stereoscopic vision suppressor to perform the stereoscopic vision suppression processing with intensity higher than that in a case where the bright spot is detected, wherein the stereoscopic vision suppressor includes a maximum value filter that replaces a gradation value of a pixel indicated by the video signal with a maximum value in the gradation values of the pixel and a plurality of pixels adjacent to the pixel, and when detecting the black spot, the black-spot and bright-spot detector controls the maximum value filter to replace the gradation value of a pixel indicated by the video signal with the maximum value while a number of the plurality of adjacent pixels is increased as compared with a case where the bright spot is detected.

8. The liquid crystal display device according to claim 7, wherein the stereoscopic vision suppressor further includes a second low-pass filter that generates the first video signal by spatially smoothing the gradation value indicated by the video signal output from the maximum value filter.

9. A video signal processing method performed by a liquid crystal display device including a first liquid crystal display panel and a second liquid crystal display panel disposed to be laminated, the video signal processing method comprising:

a first video signal generating step of generating a first video signal for the first liquid crystal display panel by performing stereoscopic vision suppression processing of suppressing stereoscopic vision due to parallax on an input video signal; and a second video signal generating step of generating a second video signal for the second liquid crystal display panel using the first video signal generated in the first video signal generating step, wherein in the first video signal generating step, a suppression processing is performed, the suppression processing that suppresses a fluctuation range of a gradation value indicated by the video signal when the video signal indicates a bright spot that is different than when the video signal indicates a black spot.

* * * * *